United States Patent [19]

Amemiya et al.

[11] 4,043,846

[45] Aug. 23, 1977

[54] METHOD OF PRODUCING FERROMAGNETIC METAL POWDER BY GASEOUS REDUCTION OF SILICON COMPOUND-COATED RAW MATERIAL

[75] Inventors: Masahiro Amemiya, Hino; Seiichi Asada, Hachioji, both of Japan

[73] Assignees: Hitachi, Ltd.; Hitachi Maxell, Ltd., both of Japan

[21] Appl. No.: 667,549

[22] Filed: Mar. 17, 1976

[30] Foreign Application Priority Data

Mar. 17, 1975 Japan ..... 50-31178
Mar. 17, 1975 Japan ..... 50-31177

[51] Int. Cl.[2] ..... H01F 1/02; C22C 1/04; B22F 3/00

[52] U.S. Cl. ..... 148/105; 75/.5 AA; 75/.5 BA; 252/62.55; 252/62.56; 252/62.58; 252/62.59

[58] Field of Search ..... 148/105; 75/.5 AA, .5 BA; 252/62.54, 62.55, 62.56, 62.58, 62.60

[56] References Cited

U.S. PATENT DOCUMENTS

| | | | |
|---|---|---|---|
| 2,651,105 | 9/1953 | Neel | 75/.5 AA |
| 2,744,040 | 5/1956 | Altmann | 148/105 |
| 3,598,568 | 8/1971 | Klomp et al. | 75/.5 AA |
| 3,607,218 | 9/1971 | Akashi et al. | 75/.5 AA |
| 3,627,509 | 12/1971 | Van Der Geissen | 75/.5 AA |
| 3,702,270 | 11/1972 | Kawasaki et al. | 75/.5 AA |
| 3,725,036 | 4/1973 | Ehrreich et al. | 75/.5 AA |
| 3,843,349 | 10/1974 | Ehrreich et al. | 75/.5 BA |

*Primary Examiner*—Walter R. Satterfield
*Attorney, Agent, or Firm*—Craig & Antonelli

[57] ABSTRACT

A method of producing ferromagnetic iron powder comprises the steps of dipping iron compound powder in a solution in which silicone oil is dissolved, removing solvent from the iron compound powder, reducing the iron compound powder in a reducing atmosphere at an elevated temperature and forming oxide layers on whole surfaces of the individual particles of the iron compound powder. Ferromagnetic iron powder produced according to this method has both a high coercive force and a high remanence ratio.

24 Claims, 5 Drawing Figures

Hc(Oe)
σm(emu/g)
σr/σm
1000
800
600
400
200
0
100
80
60
40
20
0
0.5
0.4
0.3
0.2
0.1
0
2
3
1
0
0.2
0.4
20
40
60
80
100
SILICONE OIL CONTENT IN SOLUTION (g/l)

Hc(Oe)
σm(emu/g)
σr/σm
1000
800
600
400
200
0
100
80
60
40
20
0
0.5
0.4
0.3
0.2
0.1
0
5
6
4
250
300
350
400
450
500
550
600
REDUCING TEMPERATURE (°C)

METHOD OF PRODUCING FERROMAGNETIC METAL POWDER BY GASEOUS REDUCTION OF SILICON COMPOUND-COATED RAW MATERIAL

BACKGROUND OF THE INVENTION

1. Field of the Invention

The present invention relates to a method of producing ferromagnetic metal powder, especially composed mainly of iron, and more particularly to a method of producing ferromagnetic metal powder usable as a high density magnetic recording medium for a magnetic tape, a magnetic drum, magnetic disc or the like.

2. Brief Description of the Prior Art

Many methods of producing ferromagnetic metal powder have been investigated heretofore. These methods can be roughly classified as follows:

i. method comprising the steps of dissolving a compound of ferromagnetic metal into water and adding thereto reducing agent containing tetrahydride borate ions or hypophosphite ions, ii. method comprising the step of reducing an oxalate, a formate, a oxide or a oxyhydroxide of ferromagnetic metal in a reducing atmosphere at an elevated temperature, iii. method comprising the steps of preparing an aqueous solution in which a compound of ferromagnetic metal is dissolved and electrolyzing the solution, and so on.

The metal powder for a magnetic recording medium of high density is desired to be composed of particles of high coercive force and high remanence ratio having needlelike shapes and uniform size. However, it is difficult to obtain such needlelike shaped and uniform-sized metal powder by the above-mentioned prior art method. Namely, according to the above-mentioned prior art method (i), we can obtain a powder composed of only sphere-shaped particles, dielike-shaped particles or chain-sphere-shaped particles which are formed by linking the globe-like or dielike-shaped particles together. According to the above-mentioned prior art method (iii), the shape of the obtained particles of the powder is only dendritic. Furthermore, in the above-mentioned prior art (ii), although somewhat needlelike shaped particle powder can be obtained when the needlelike shaped oxalate, formate, oxide or oxyhydroxide is used as starting material, it is difficult to obtain uniform-sized metal powder having needlelike shapes because the particles link together or break in the reducing process at an elevated temperature. As mentioned above, it is very difficult to obtain needle-like shaped ferromagnetic powder according to the prior art.

SUMMARY OF THE INVENTION

It is an object of the present invention to provide an improved method to produce ferromagnetic metal powder. It is another object of the present invention to provide an improved method to produce ferromagnetic iron powder. It is still another object of the present invention to provide a method of producing needlelike-shaped and uniform sized ferromagnetic iron powder having both a high coercive force and a high remanence ratio.

On our various investigations concerning the method of producing needlelike ferromagnetic metal powder, it was found that the needlelike ferromagnetic metal powder could be obtained according to the method in which the above-mentioned prior art method (ii) was improved. The present invention, which is based on our above-mentioned discovery, provides a method for producing needlelike-shaped ferromagnetic metal powder having a high coercive force and a high remanece ratio, by improving the above-mentioned prior art method (ii) which comprises the step of reducing a metal compound such as a oxalate, a formulate, a oxide or a oxyhydroxide of ferromagnetic metal at an elevated temperature.

In the method of the present invention, there also may be used as a starting raw material, oxalate, formate, oxide or oxyhydroxide of ferromagnetic metal or their mixture, among which iron compound is preferable because of the high value of the magnetization in the obtained metal, and among which the oxide and the oxyhydroxide are preferable too because of the facility of obtaining needlelike shaped powder. Furthermore, another reason why the oxide is preferable is that the number of atoms made free at the reducing step is few whereby the particles are hard to break down. Accordingly, the iron oxide and the iron oxyhydroxide, especially the iron oxide, are more preferable for the starting material in the method of the present invention. Among the iron oxide usable as the starting material, magnetite and ferric oxide such as maghemite are desirable because of the facility of obtaining needlelike shaped powder. It is to be desired that the particles of the raw material are needlelike. In addition, the iron oxide containing Co, Ni, Al, Cr, Mg, B or the like may be used as the starting material to improve corrosion-resistance property.

In this invention, the above-mentioned starting material powder preferably composed mainly of iron compound is reduced by heating it in a reducing atmosphere after the starting material powder is coated with a solution of inorganic silicon compound or a solution of organic silicon compound, which has a boiling point of higher than 250° C., and then the solvent of the solution is removed by drying. The drying step may be omitted when the solvent can be removed by natural drying, in another step. As the inorganic silicon compound or organic silicon compound, there is usually used a silicate such as sodium silicate or the like listed in Table 3 or silicon oil, respectively. The latter is used more usually. Furthermore, a more desirable result can be obtained when a solution containing silver ions is used with the above-mentioned silicon compound solution. Both of them may be used as a mixed solution or as separate two solutions. The starting material powder is dipped once in the former case, but twice in the latter case, namely, it should be dipped in a silicon compound solution and in a silver ions solution separately. As the silver compound used for the solute of the silver ions containing solution, there can be used many silver salts such as silver nitrate, silver sulfate and silver chloride.

For the solvent of silicone oil, many organic solvents, such as ketone, formamide, aromatic compound can be used. Water, aqueous acidic solution and aqueous alkaline solution are used for solvents for inorganic silicon compounds. In the solution containing silver ions, water, liquid ammonia, strong inorganic acid or alcohol are employed as solvents. However, the latter can be used only for silver nitrate.

In the method of the present invention, the amount of inorganic silicon compound or organic silicon compound, such as silicone oil, in the above-mentioned solution is more than 0.05 g/l. When the amount of silicon compound in the solution is less than 0/05 g/l, it is difficult to expect a better result than the prior art method. The preferable amount of the silicon compound in the solution is more than 0.1 g/l and the more preferable amount thereof is more than 0.2 g/l. Furthermore, the silver compound may be contained in the solution in amount of more than 0.02 g/l and preferably more than 0.05 g/l. The upper limit value thereof may be determined by the concentration in the saturated solution.

For example, FIG. 1 shows the relation between the silicone oil concentration in the solution and the magnetic properties of the obtained ferromagnetic iron powder in the method of the present invention. As apparent from this figure, the ferromagnetic metal powder produced according to the method of this invention is greatly improved in the coercive force (curve 1) and the remanence ratio (curve 2), as compared with the case in which no silicone oil is used as in the prior art method. In addition, it is obvious that a large desirable effect can be obtained using even very dilute solution of the silicone oil. The detailed description about FIG. 1 will be read later in the description concerning example 1.

Any reducing atmosphere containing reducing gas such as $H_2$ and CO may be used at the heating step for reduction, additionally $H_2$ gas and town gas can be obtained easily to thereby be preferable.

The suitable ratio of $H_2$ to $H_2O$, CO to $CO_2$ or the like for reducing $Fe_3O_4$, which is the rate-determining step in reducing every kind of iron oxide, is known well in this field or in the field of the iron and steel production. To the method of the present invention, the above-mentioned well-known suitable ratio may be applied.

The suitable reducing temperature ranges from 250° to 600° C. in the case that the solute of the solution in which the starting material powder is dipped is only silicon compound, especially silicone oil or sodium silicate. It ranges from 200° to 700° C. in the case of using both silver salt and silicon compound as the solutes. It ranges preferably from 300° to 550° C. in the former case, and from 250° to 600° C. in the latter case.

When the heating temperature is lower than the above-mentioned lower limit of the suitable temperature range, the reducing phenomenon occurs insufficiently. On the other hand, the reduced particles stick together, when the heating temperature is higher than the above-mentioned upper limit of that range. Of course, both cases are not suitable.

According to the composition of the reducing atmosphere and the heating temperature, various heating time is necessary for reduction process. The composition of the discharged gas of the heating atmosphere is somewhat different from the composition of the charged gas during the reduction process, but it becomes almost the same as that of the charged gas in the range of the compositional intrinsic fluctuation after the reduction process is completed. Accordingly, we can recognize the completion of the reduction process by detecting the discharged gas composition, and the necessary heating time becomes apparent naturally.

The produced powder can become corrosion-resistant and be convenient to handle, by forming surface layers such as oxide layers on the surface of the produced metal particles according to the well-known method concerning the nonactivation treatment of pure iron, namely by making the particle surfaces nonactive.

The ferromagnetic metal powder produced according to the aforementioned method has both a high coercive force and a high remanence ratio as compared with that produced by a conventional method.

Other and further objects, features and advantages of the invention will be apparent more fully from the following description taken in connection with the accompanying drawings.

DESCRIPTION OF THE PRESENTLY PREFERRED EMBODIMENTS

EXAMPLE 1

One hundred grams of needlelike maghemite ($\gamma$-$Fe_2O_3$) were dipped in 200 ml of solution of silicone oil, the amount of which was various, which had 100 cs (centistokes) viscosity and which was dissolved in methylethyl ketone, then the solution was stirred for 1 hour, and dried in vacuum. Five grams of the maghemite obtained thus were reduced by heating in an atmosphere of hydrogen at 360° C. for 2 hours. After that, the reduced material was cooled slowly to about 100° C., then the atmosphere waas changed from hydrogen to nitrogen at 100° C. After this change of the atmosphere, it was cooled to room temperature taking one day and one night, simultaneously gradually introducing air into the sample vessel through a hole of 2 mm diameter. Then, there was obtained metal powder, the surface of which were covered with iron oxide and which was composed of fine needlelike particles having axial ratio (namely the ratio of the major axis length to the minor axis length) of 8, and major axis length of 0.4 $\mu$m.

Figure 1:
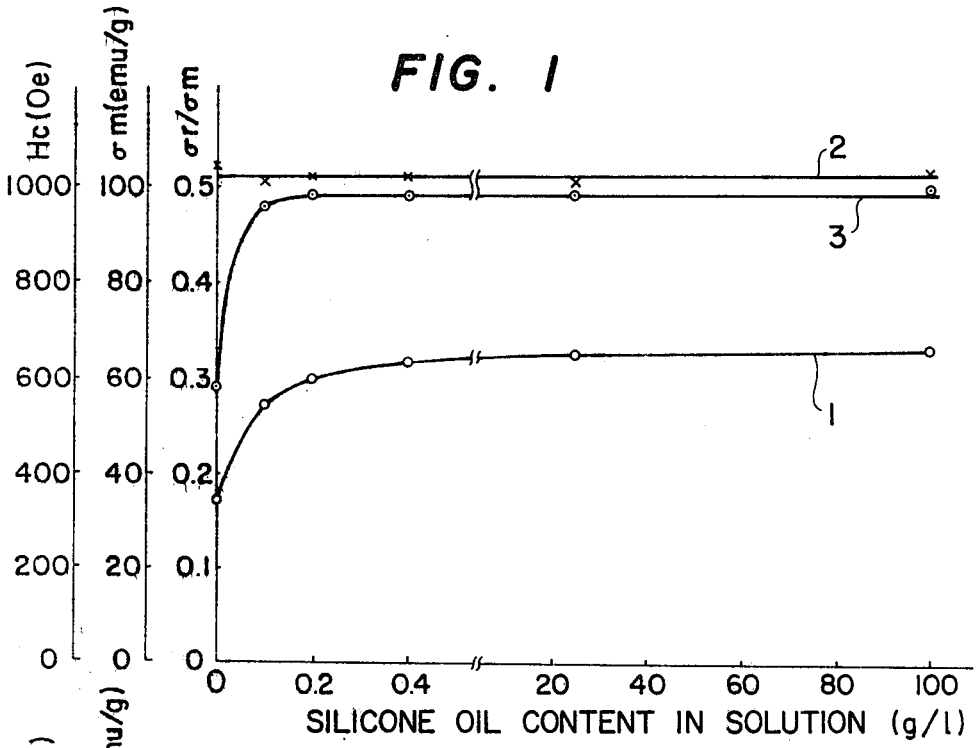
FIG. 1 is a diagram illustrating the relation between the silicone oil concentration in the solution containing no silver ion and the magnetic properties of the obtained iron powder in an embodiment of the present invention.

FIG. 1 illustrates the relation between the silicone oil content in the used solution and the magnetic properties of the metal powder obtained as mentioned above. In the figure, curves 1, 2 and 3 represent the coercive force Hc, the maximum magnetization $\sigma m$ and the remanence ratio $\sigma r/\sigma m$ respectively.

The magnetic properties of the samples were measured in the magnetic field of 2000 Oe at maximum with the use of a B-H tracer.

As apparent from FIG. 1, we could obtain ferromagnetic metal powder being excellent in the coercive force and the remanence ratio, by the above-mentioned method comprising the steps of dipping maghemite in the silicone oil solution and reducing it at an elevated temperature. A remarkable effect may be expected even when the silicone oil content in the solution is so low as 0.1 g/l.

EXAMPLE 2

The same procedures as Example 1 were carried out with the exception that the silicone oil content in the solution was merely 5 g/l and the various reducing temperatures were taken.

Figure 2:
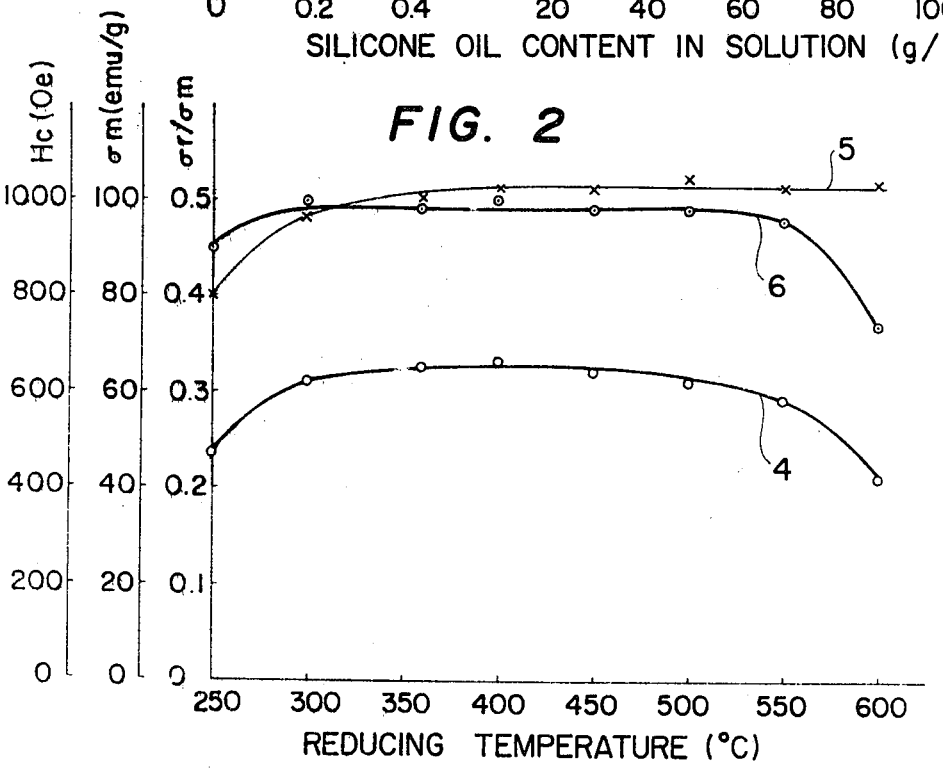
FIG. 2 is a diagram illustrating the relation between the reducing temperature and the magnetic properties of the obtained iron powder in another embodiment of the present invention.

The magnetic properties of the obtained metal powder samples are represented by FIG. 2, in which curves 4, 5 and 6 represent the coercive force Hc, the maximum magnetization $\sigma m$ and the remanence ratio $\sigma r/\sigma m$, and from which it is apparent that the ferromagnetic metal powder of high coercive force and high remanence ratio can be obtained by the aforementioned method in which the reducing temperature is between 300° and 550° C. Furthermore, the metal powder particle, obtained by reducing at from 300° to 550° C., had axial ratio of 8 and major axis length of 0.4 μm, and it was a very needlelike fine particle.

EXAMPLE 3

The procedures of Example 1 were repeated in the same manner except that various silicone oils having viscosities of higher than 100 cs were used, the silicone oil content in the solution was 5g/l and the employed solvent for the solution was N,N-dimethyl formamide, to thereby produce metal powder, the magnetic properties of which are shown in Table 1.

Table 1.

Silicone Oil Viscosity Dependency of Magnetic Properties of Samples.

| Sample No. | Viscosity (cs) | Hc(Oe) | $\sigma$ m(emu/g) | $\sigma$ r/$\sigma$ m |
|---|---|---|---|---|
| 1 | 100 | 650 | 101 | 0.49 |
| 2 | 300 | 670 | 103 | 0.51 |
| 3 | 1000 | 650 | 100 | 0.49 |
| 4 | 3000 | 640 | 104 | 0.50 |

As seen from Table 1, every silicone oil had an enough effect. In addition, the obtained metal powder particle had axial ratio of 8 and major axis length of 0.4μm to thereby be a very needlelike fine particle.

EXAMPLE 4

The procedures of Example 1 were repeated in the same manner with the exception that magnetite was used as the raw oxide and the silicone oil content in the solution was 5g/l, to thereby produce metal powder, the magnetic properties of which were as follows: The coercive force Hc, the maximum magnetization $\sigma m$ and the remanence ratio $\sigma r/\sigma m$ were 630 Oe, 102 emu/g and 0.49 respectively. The obtained metal powder particle had axial ratio of 8 and major axis length of 0.4 μm.

As is seen from the description on this example, there can be obtained metal powder of much the same quality as that produced using maghemite as starting material, even when magnetite is used as the starting raw material.

EXAMPLE 5

The procedures of Example 4 were repeated in the same manner with the exception that maghemite, whose particle surfaces were covered with nickel by electroless plating, was used as the starting raw material. The ratio of the amount of Fe to that Ni in the obtained metal powder was 90:10. The magnetic propertes thereof were as follows: The coercive force Hc, the maximum magnetization $\sigma m$ and the remanence ratio $\sigma r/\sigma m$ were 600 Oe, 96 emu/g and 0.47 respectively. Furthermore, respecting the particle shape and particle size thereof, the axial ratio and the major axis length were 6 and 0.4 μm respectively.

As seen from the above-mentioned description on this example, we can obtain the Ni containing iron powder exceling in Hc and $\sigma r/\sigma m$, in accordance with the method of the present invention.

EXAMPLE 6

The procedures of Example 4 were repeated in the same manner with the exception that the 5 at % Co containing maghemite were used as the starting raw material and town gas was used as the reducing gas, to thereby produce metal powder.

The magnetic and dimensional properties of the obtained metal powder particle were as follows: The coercive force Hc, the maximum magnetization $\sigma m$ and the remanence ratio $\sigma r/\sigma m$ were 700 Oe, 101 emu/g and 0.53 respectively, the axial ratio was 7 and the major axis length was 0.4 μm.

From the above-said description concerning this example, it becomes apparent that the Co containing iron powder, which excels in Hc and $\sigma r/\sigma m$ can be obtained according to the method of the present invention.

EXAMPLE 7

One hundred grams of needlelike maghemite were dipped in 200 ml of solution of silicone oil, the content of which was 5 g/l, which had 100 cs viscosity and which was dissolved in methyl-ethyl ketone, then the solution was stirred for 1 hour. After that, the maghemite containing solution was added to 200 ml of solution of silver nitrate $AgNO_3$ dissolved in ethanol, stirred for 1 hour, and dried in vacuum. The content of $AgNO_3$ in the solution was various.

Five grams of the maghemite obtained thus were reduced by heating in an atmosphere of hydrogen at 360° C. for 2 hours. The reduced material was cooled slowly to about 100° C., then the atmosphere was changed from hydrogen to nitrogen at 100° C. After this change of the atmosphere, it was cooled to room temperature taking one day and one night, simultaneously gradually introducing air into the sample vessel through a hole of 2 mm diameter. Then, there was obtained metal powder, the surfaces of which were covered with iron oxide and which was composed of fine needlelike particles having axial ratio of 8, and major axis length of 0.4 μm.

Figure 3:
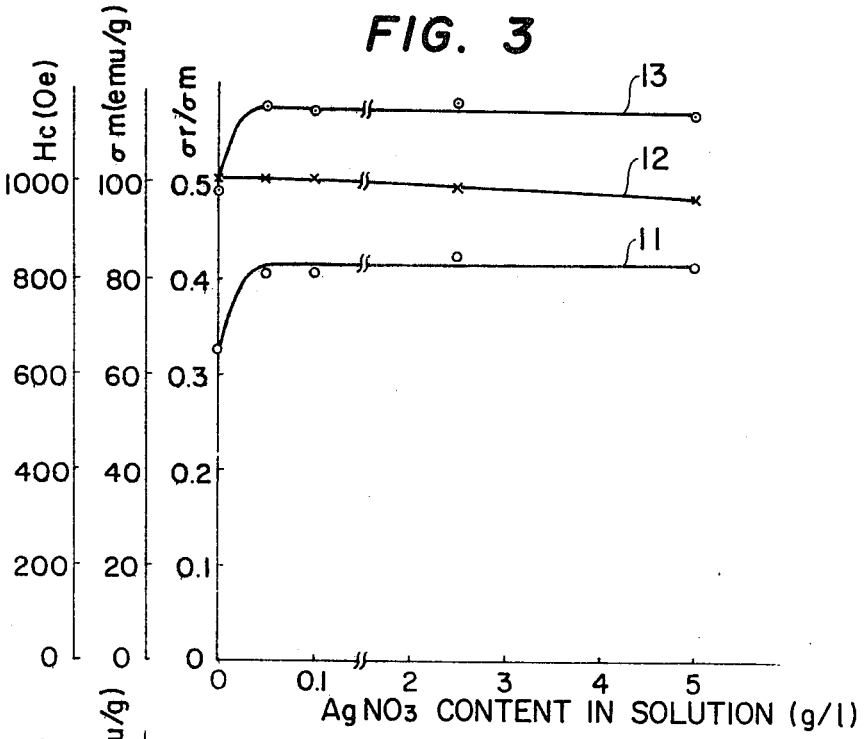
FIG. 3 is a diagram illustrating the relation between the silver ions concentration in the solution containing silver ions and silicone oil and the magnetic properties of the obtained iron powder in still another embodiment of the present invention.

FIG. 3 illustrates the relation between the silver nitrate content in the solution and the magnetic properties of the metal powder obtained as mentioned above. In the figure curves 11, 12 and 13 represent the coercive force Hc, the maximum magnetization $\sigma m$ and the remanence ratio $\sigma r/\sigma m$ respectively.

The magnetic properties of the samples were measured in the magnetic field of 2000 Oe at maximum with the use of a B-H tracer.

As apparent from FIG. 3, we could obtain ferromagnetic iron powder being very excellent in the coercive force and the remanence ratio, by the above-mentioned method comprising the steps of dipping maghemite in the silicone oil solution followed by the silver nitrate solution and reducing it at an elevated temperature. An enough effect may be expected even when the silver nitrate content in the solution is so low as 0.05 g/l.

EXAMPLE 8

One hundred grams of needlelike maghemite were dipped in 200 ml of solution of silver nitrate, the content of which was 5 g/l and which was dissolved in ethanol, then the solution was stirred for one hour. After that, the solution bearing the maghemite was added to 200 ml of solution of silicone oil, the content of which was various, which had 100 cs viscosity and which was dissolved in methyl-ethyl ketone, then it was stirred for 1 hour. The subsequent procedures, namely drying, reducing at an elevated temperature and cooling, were the same as Example 7.

The surfaces of the obtained metal powder were covered with iron oxide and the powder was composed of fine needlelike particles having axial ratio of 8, and major axis length of 0.4 μm.

Figure 4:
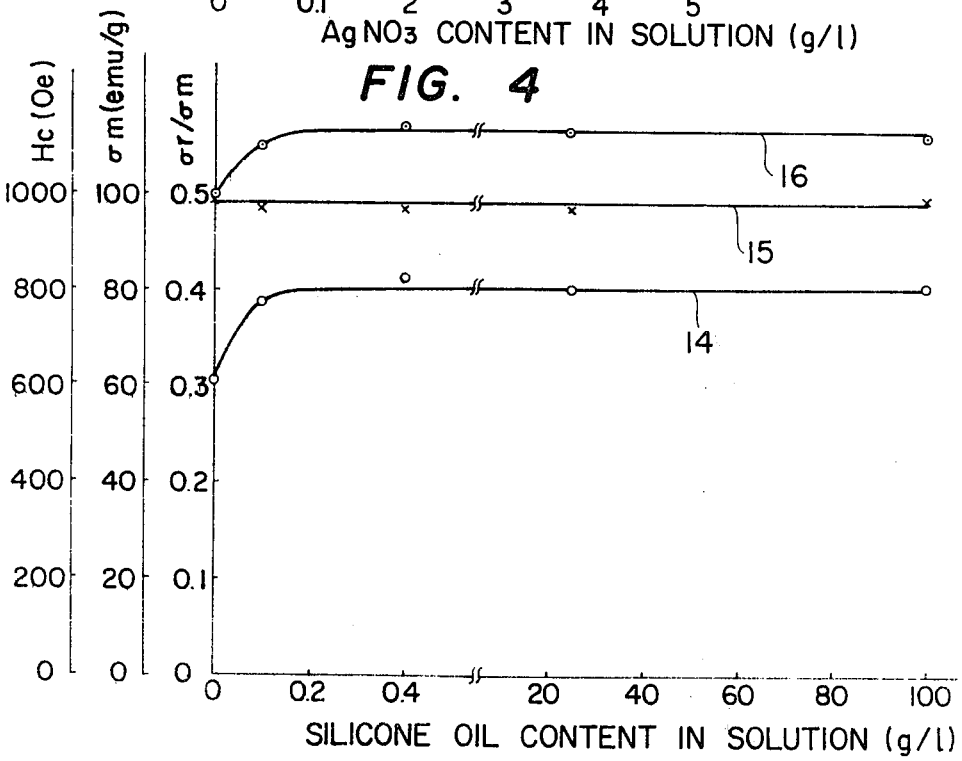
FIG. 4 is a diagram illustrating the relation between the silicone oil concentration in the solution containing silver ions and silicone oil and the magnetic properties of the obtained iron powder in a further embodiment of the present invention.

FIG. 4 illustrates the relation between the silicone oil content in the solution and the magnetic properties of the obtained metal powder. The measuring method of the magnetic properties were the same as Example 7.

As seen from FIG. 4, there could be obtained ferromagnetic iron powder being very excellent in the coercive force, curve 14, and the remanence ratio, curve 16, by the above-disclosed method. Curve 15 represents the maximum magnetization. A remarkable effect may be expected even when the silicone oil content in the solution is so low as 0.1 g/l.

EXAMPLE 9

One hundred grams of needlelike maghemite were dipped in 200 ml of solution of silicone oil dissolved in methyl-ethyl ketone and in 200 ml of solution of silver nitrate dissolved in ethanol, and dried. The content of silicone oil and silver nitrate in the solution were 5 g/l and 1 g/l respectively. The subsequent procedures, namely reducing at an elevated temperature and cooling, were the same as Example 7 except that the various reducing temperatures were taken.

Figure 5:
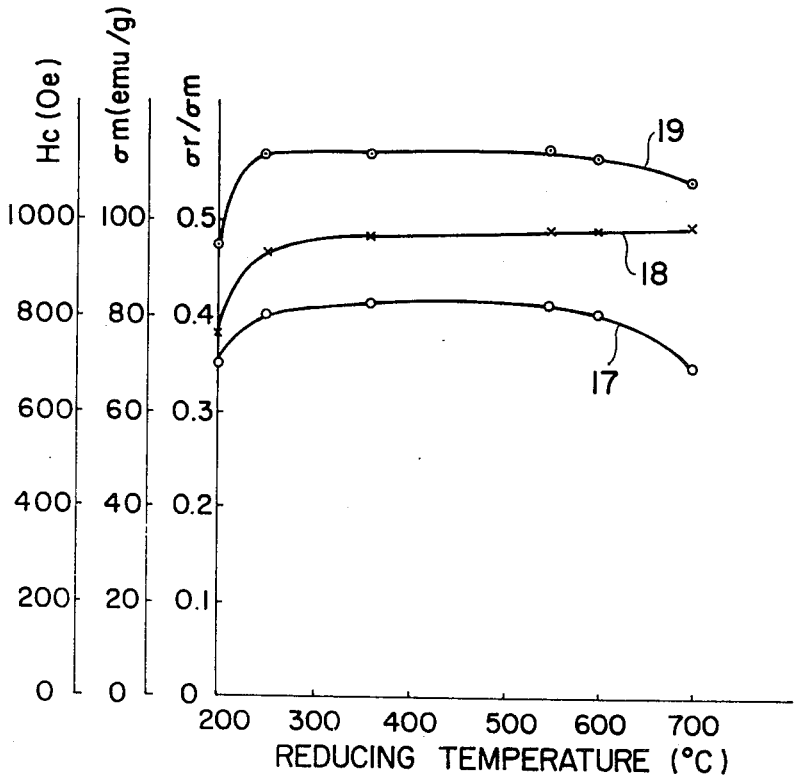
FIG. 5 is a diagram illustrating the relation between the reducing temperature and the magnetic properties of the obtained iron powder in a still further embodiment of the present invention.

FIG. 5 illustrates the reducing temperature dependency of the magnetic properties of the obtained metal powder.

As apparent from FIG. 5, the ferromagnetic metal powder of very high coercive force, curve 17, and very high remanence ratio, curve 19, can be obtained by the afore-disclosed method in which the reducing temperature is between 250° and 600° C. Furthermore, the metal powder particle, obtained by reducing at from 250° to 600° C., had axial ratio of 8 and major axis length of 0.4 μm, and it was a very needle-like fine particle. Curve 18 of FIG. 5 represents the maximum magnetization.

EXAMPLE 10

The procedures of Example 9 were repeated in the same manner except that various silicone oils having viscosities of higher than 100 cs were used, the employed solvent for the silicone oil solution was N,N-dimethyl formamide, magnetite was used as the raw oxide and the reducing temperature was merely 360° C., to thereby produce metal powder, the magnetic properites of which are shown in Table 2.

Table 2.

Silicone Oil Viscosity Dependency of Magnetic Properties of Samples.

| Sample No. | Viscosity (cs) | Hc(Oe) | $\sigma$ m(emu/g) | $\sigma$ r/$\sigma$ m |
|---|---|---|---|---|
| 11 | 100 | 820 | 101 | 0.57 |
| 12 | 300 | 830 | 100 | 0.58 |
| 13 | 3000 | 820 | 102 | 0.58 |

As seen from Table 2, every silicone had an enough effect. In addition, the obtained metal powder particle had axial ratio of 8 and major axis length of 0.4 μm to thereby be a very needlelike fine particle.

EXAMPLE 11

The procedures of Example 9 were repeated in the same manner with the exception that maghemite, whose particle surfaces were covered with nickel by electroless plating, was used as the starting raw oxide and the reducing temperature was merely 360° C., to thereby produce metal powder. The ratio of the amount of Fe to that of Ni in the obtained metal powder was 90:10.

The magnetic properties thereof were as follows: The coercive force Hc, the maximum magnetization $\sigma m$ and the remanence ratio $\sigma r/\sigma m$ were 780 Oe, 95 emu/g and 0.55 respectively. Furthermore, respecting the particle shape and particle size thereof, the axial ratio and the major axis length were 6.5 and 0.4 μm respectively.

As apparent from the afore-said description, we can obtain the Ni containing iron powder exceling in Hc and $\sigma r/\sigma m$ by the method of the present invention.

EXAMPLE 12

The procedures of Example 10 were repeated in the same manner except that the 5 at % Co containing maghemite was used as the starting raw oxide, the used silicone oil had the viscosity of merely 100 cs and town gas was used as the reducing gas, whereby metal powder was produced.

The magnetic and dimensional properties of the obtained metal powder particle were as follows: The coercive force Hc, the maximum magnetization $\sigma m$ and the remanence ratio $\sigma r/\sigma m$ were 910 Oe, 100 emu/g and 0.58 respectively, the axial ratio was 7 and the major axis length was 0.4 μm.

From the above-mentioned description concerning this example, it becomes apparent that the Co containing iron powder, which excels in Hc and $\sigma r/\sigma m$, can be obtained by the method of the present invention.

EXAMPLE 13

The procedures of Example 9 were repeated in the same manner with the exception that the aqueous solution of silver sulphate of 2 g/l in concentration was used as a solution containing silver ions and the reducing step were carried out at 360° C., whereby we obtained metal powder. The magnetic and dimensional properties of the obtained metal powder particles were as follows: The coercive force Hc, the maximum magnetization $\sigma m$ and the remanence ratio $\sigma r/\sigma m$ were 750 Oe, 103 emu/g and 0.56 respectively, the axial ratio was 7.5 and the major axis length was 0.35 μm.

From the above-mentioned description on this example, it becomes apparent that the ferromagnetic iron powder having a very high coercive force and a very high remanence ratio can be obtained by the method in which the silver sulphate solution was used as the silver ions containing solution.

EXAMPLE 14

The same procedures as Example 9 were conducted with the exception that the aqueous solution of ammonia containing silver chloride of 2 g/l in concentration was used as a solution of silver ions and the reducing step were carried out at 360° C, whereby metal powder was produced. With respect to the magnetic properties of the obtained metal powder, the coercive force Hc, the maximum magnetization $\sigma m$ and the remanence ratio $\sigma r/\sigma m$ were 780 Oe, 98 emu/g and 0.56 respectively. Furthermore, the axial ratio and the major axis length thereof were 7 and 0.4 μm, respectively.

From the above-mentioned results of this example, it becomes apparent that the ferromagnetic iron powder very excelent in Hc and $\sigma r/\sigma m$ can be obtained by the method in which silver chloride solution was used as a solution containing silver ions.

EXAMPLE 15

One hundred grams of needlelike α-FeOOH were dipped in 400 ml of solution of silicone oil, the content of which was 5 g/l, which had 100 cs viscosity and which was dissolved in methyl-ethyl ketone, then the solution was stirred for 1 hour, subsequently sucked through a filter, and the solid part obtained by filtering was dried in vacuum. Five grams of the α-FeOOH obtained thus were reduced by heating in an atmosphere of hydrogen at 370° C. for 2 hours. The following procedures of cooling were the same as Example 1.

The surfaces of the obtained metal powder were covered with iron oxide and the powder was composed of fine needlelike particles having axial ratio of 8, and major axis length of 0.4 μm. The coercive force Hc, the maximum magnetization $\sigma m$ and the remanence ratio $\sigma r/\sigma m$ of the obtained powder were 700 Oe, 100 emu/g and 0.52 respectively. The measuring method of the magnetic properties were the same as Example 1.

From the above-mentioned experimental results, it becomes apparent that ferromagnetic iron powder having the excellent qualities in the coercive force and the remanence ratio, by the above-disclosed method comprising the steps of dipping α-FeOOH in the silicone oil solution and reducing it at an elevational temperature.

A remarkable effect was observed even when the silicone oil content in the solution was so low as 0.1 g/l.

EXAMPLE 16

One hundred grams of needlelike $\gamma$-$Fe_2O_3$ were dipped in 400 ml of solution shown at Table 3, then the solution was stirred for 1 hour, subsequently sucked through a filter, and the solid part obtained by filtering was dried in vacuum. The solute contents in the used solution were 2.5 g/l. Five grams of the $\gamma$-$Fe_2O_3$ obtained thus were reduced by heating in an atmosphere of hydrogen at 360° C. for 2 hours. The following procedures of cooling and the method of measuring the magnetic properties were the same as Example 1. Results are shown in Table 3. In addition, the obtained metal powder particle had axial ratio of 8 and major axis length of 0.4 μm, to thereby be a very needlelike fine particle.

As is seen from Table 3, an enough effect may be expected whichever inorganic silicon compound solution is used.

Table 3.

Magnetic Properties of the Iron Powder Produced Using Various Solutions

| Sample No. | Solute | Solvent | Hc (Oe) | σ m (emu/g) | σ r/σ m |
|---|---|---|---|---|---|
| 21 | Sodium Silicate | Water | 695 | 100 | 0.52 |
| 22 | Potassium Silicate | Water | 700 | 103 | 0.53 |
| 23 | Silicic Acid | Aqueous Solution of 1 N Caustic Soda | 690 | 104 | 0.53 |
| 24 | Potassium Metasilicate | Water | 710 | 103 | 0.53 |
| 25 | Magnesium Silicate | 1 N Hydrochloric acid | 650 | 105 | 0.51 |
| 26 | Cobalt Silicate | " | 680 | 104 | 0.52 |
| 27 | Calcium Metasilicate | " | 670 | 104 | 0.52 |
| 28 | Metasilicic Acid | Aqueous Solution of 1 N Caustic Potash | 690 | 103 | 0.53 |
| 29 | Sodium Metasilicate | Water | 720 | 103 | 0.53 |

REFERENCE EXAMPLE 1

This reference example relates to ferromagnetic iron powder produced according to a conventional method.

Five grams of needlelike maghemite were were reduced by heating in an atomosphere of hydrogen at 360° C. for 2 hours. The the reduced material was cooled in the same manner as Example 1. The magnetic properties of the ferromagnetic iron powder obtained thus were measured by B-H tracer in the magnetic field of 2000 Oe at maximum. The resulting data were as follows: Hc, $\sigma m$ and $\sigma r/\sigma m$ were 340 Oe, 104 emu/g and 0.29 respectively.

Therefore, it is apparent that the ferromagnetic metal powder produced by a conventional method has inferior qualities in the magnetic properties such as the coercive force and the remanence ratio in comparison with the powder produced by the method of the present invention.

While the novel principles of the invention have been described, it will be understood that various omissions, modifications and changes in these principles may be made by one skilled in the art without departing from the spirit and scope of the invention.

What is claimed is:

1. A method of producing ferromagnetic metal powder comprising the sequential steps of:

i. coating a starting raw material powder with a solution containing more than 0.05 g/l of one silicon compound selected from the group consisting of sodium silicate, potassium silicate, silicic acid, potassium metasilicate, magnesium silicate, cobalt silicate, calcium metasilicate, metasilicic acid, sodium metasilicate and silicone oil and a solution containing ions of a silver compound in which the content of silver compound is more than 0.02 g/l, said raw material being at least one selected from the group consisting of oxalate, formate, oxide and oxyhydroxide of iron, ii. heating said powder at temperature ranging from 200° to 700° C. in a reducing atmosphere, and iii. cooling said powder reduced in the preceding step (ii).

2. A method of producing ferromagnetic metal powder comprising the steps of:

i. coating a starting raw material powder with a solution containing more than 0.05 g/l of one silicon compound selected from the group consisting of sodium silicate, potassium silicate, silicic acid, potassium metasilicate, magnesium silicate, cobalt silicate, calcium metasilicate, metasilicic acid, sodium metasilicate and silicone oil and a solution containing ions of a silver compound in which the content of silver compound is more than 0.02 g/l, said raw material being at least one selected from the group consisting of oxalate, formate, oxide and oxyhydroxide of iron, ii. drying said powder coated at step (i), iii. heating said powder at temperature ranging from 200° to 700° C. in a reducing atmosphere, and iv. cooling said powder reduced in the preceding step (iii).

3. The method of claim 2, in which said raw material is at least one selected from the group consisting of iron oxide and iron oxyhydroxide.

4. The method of claim 2, in which said raw material is iron oxide.

5. The method of claim 2, in which said raw material is at least one selected from the group consisting of ferric oxide and magnetite.

6. The method of claim 5, in which said raw material further comprises at least one element selected from the group consisting of Ni, Co, Al, Cr, Mg and B.

7. The method of claim 2, in which said silicon compound is silicone oil.

8. The method of claim 7, in which said silicone oil is dissolved in a organic solvent.

9. The method of claim 2, in which said content of silicon compound is more than 0.1 g/l.

10. The method of claim 2, in which said content is more than 0.2 g/l.

11. The method of claim 2, in which the temperature of heating said powder ranges from 250° to 600° C.

12. The method of claim 2, in which a step of forming surface layers on the surface of the particles composing said powder is added after step (iii).

13. The method of claim 2, in which said raw material is iron oxide, and said solution is a solution of silicone oil dissolved in an organic solvent.

14. The method of claim 13, in which the content of said silicone oil is more than 0.2 g/l and said heating temperature ranges from 250 ° to 550° C.

15. The method of claim 2, in which said silicon compound is silicone oil and said solution containing silver ions is a solution of one silver salt selected from the group consisting of silver nitrate, silver sulfate and silver chloride.

16. The method of claim 2, in which said content of said silicon compound is more than 0.2 g/l and said content of said silver compound is more than 0.05 g/l.

17. The method of claim 16, in which said raw material is iron oxide, said silicon compound is silicone oil dissolved in an organic solvent and the heating temperature at step (iii) ranges from 250° to 600° C.

18. The method of claim 2, in which both of said solution containing a silver compound and said solution containing silver ions are contained in a mixed solution.

19. The method of claim 2 in which said solution containing silver ions is a solution of at least one silver compound selected from the group consisting of silver nitrate, silver sulfate and silver chloride.

20. The method of claim 19, in which said solution containing said silver ions is said solution of said one silver compound dissolved in a solvent selected from the group consisting of water, liquid ammonia, strong inorganic acid and alcohol.

21. The method of claim 2, in which said content of silver compound is more than 0.05 g/l.

22. The method of claim 2, in which said raw material is iron oxide, said solution containing said silicon compound is a solution of more than 0.2 g/l of silicone oil dissolved in an organic solvent, said silver ion containing solution is a solution of more than 0.05 g/l of one silver compound selected from the group consisting of silver nitrate, silver sulfate and silver chloride and the heating temperature at step (iii) ranges from 250° to 600° C.

23. The method of claim 2 wherein the starting raw material is coated by immersing the raw material initially into the solution containing the silicon compound, and the solution containing the raw material is added to the solution of the silver compound.

24. The method of claim 2, wherein the raw material is coated by initially immersing the raw material into the solution of the silicon compound and then the raw material is immersed in the solution of the silver compound.

* * * * *